United States Patent [19]

Riegler et al.

[11] 4,023,785

[45] May 17, 1977

[54] TILTABLE METALLURGICAL CONVERTER ARRANGEMENT

[75] Inventors: Ernst Riegler, Enns; Manfred Schmidt, Linz, both of Austria

[73] Assignee: Vereinigte Osterreichische Eisen - und Stahlwerke - Alpine Montan Aktiengesellschaft, Linz, Austria

[22] Filed: Feb. 11, 1976

[21] Appl. No.: 657,309

[30] Foreign Application Priority Data

Feb. 19, 1975 Austria ..... 1228/75

[52] U.S. Cl. ..... 266/245; 266/91

[51] Int. Cl.[2] ..... C21C 5/46

[58] Field of Search ..... 266/243, 245–247, 266/91; 75/59, 60

[56] References Cited

UNITED STATES PATENTS

| | | | |
|---|---|---|---|
| 3,262,691 | 7/1966 | Vanderbeck | 75/60 |
| 3,773,497 | 11/1973 | Grenfell et al. | 75/60 |
| 3,910,654 | 10/1975 | Schwarz et al. | 266/246 |

*Primary Examiner*—Gerald A. Dost
*Attorney, Agent, or Firm*—Brumbaugh, Graves, Donohue & Raymond

[57] ABSTRACT

A tiltable metallurgical converter arrangement, with a fixed bearing and an expansion bearing for the carrying trunnions, has bearing housings arranged on load cells that rest on a supporting construction designed as a sole plate. The bearing housings are secured relative to the supporting construction by adapted to accommodate tensile forces and connecting means arranged in a horizontal plane opposite each other. Thus a strictly vertical force impact on the load cells is guaranteed.

8 Claims, 3 Drawing Figures

TILTABLE METALLURGICAL CONVERTER ARRANGEMENT

BACKGROUND OF THE INVENTION

The invention relates to a tiltable metallurgical vessel, in particular a steel making converter vessel having a fixed bearing and an expansion bearing for the carrying trunnions, wherein the bearings housings are mounted on load cells that rest on the supporting construction.

In recently developed metal production processes and in particular in steel production processes, the weight changes of the materials charged are used for controlling the production process. Curves showing the changes of the weight of the bath are recorded for monitoring the process. The course of the curves allows for conclusions to be reached concerning the carbon content of the melt, the temperature of the bath, as well as the tendency towards slopping. Therefore, the precise weighing of the material charged and the additions during the heats is very important. It is a prerequisite for an exact measurement of the weight that only vertical forces act on the load cells because transversal forces distort the result of the measurement or make it inaccurate.

In hitherto constructed converters equipped with load cells or weighing transducers, the load cells were placed under the pedestal structure, or the carrying trunnion bearing housings were guided in the vertical direction by rollers in a recess of the pedestal containing the load cells (British Pat. No. 1,373,652). In another apparatus an intermediate plate having a thickness of 25 to 60 mm was arranged between the bearing housing and the supporting construction, which intermediate plate accommodated all the forces resulting from the expansion bearing displacement, the skull pushing and the converter operation.

All the known above-mentioned apparatuses do not meet the prerequisite of an exclusively vertical force or load impact on the load cells. When an intermediate plate is used, it is subjected to a statically undefined wear, and therefore it is necessary to use a plate having a yield point that is as high as possible, such as a plate having spring steel quality. However during the weighing procedure the yield point of the plate must not be exceeded, i.e. the wear must remain within the elastic range. Such plates, which for safety reasons must be overdimensioned, are not only difficult to get, but are also very expensive. Furthermore, the load cells must be frequently re-adjusted, e.g. each time after skull pushing, which means a loss of time and production.

Summary of The Invention

The present invention aims at preventing th above described disadvantages and difficulties and has as its object to create a metallurgical vessel, in particular a converter to be used in a steel making plant, that is equipped with load cells and that has a statically definite means for supporting and securing the converter bearing means relative to the supporting construction. This is necessary in order to assure a strictly vertical force impact on the load cells the avoidance of transversal forces and other uncontrollable influences at the bearing faces of the bearing housings on the load cells, and thus an accurate weighing of the contents of the vessel.

This object of the invention is achieved in a metallurgical vessel of the above-defined kind in that the bearing housings are secured relative to a supporting construction that is designed as a sole plate, by connecting means adapted to accommodate tensile forces and arranged opposite each other in a horizontal plane.

According to a preferred embodiment, the connecting means are arranged in the plane of the bearing faces of the bearing housings on the load cells. As a result reaction moments, caused by the tensile forces and causing a transversal force on the load cells, are prevented. The connecting means accommodating the tensile forces advantageously are arranged in the direction of the axis of the carrying trunnion and perpendicular thereto. According to a preferred embodiment, the connecting means are designed as screw bolts with adjusting nuts which are guided with play in bores of the sole plate, thereby securing the bearing housing without play relative to the sole plate. Advantageously, the bearing housings are provided with two opposing noses pointing in the direction of the axis of the carrying trunnion and engaging corresponding recesses of the sole plate with pay. Thus displacement of the bearing housings is prevented when the force measuring device fails. Furthermore, advantageously, an intermediate rubber layer is provided between the bearing housing and the bottom part of the sole plate, which layer accommodates the weight of the converter when the force measuring device fails and thus prevents an interruption of operation. In the area of the recesses of the sole plate, in another advantageous embodiment, further connecting means capable of accommodating tensile forces and arranged opposite each other in the direction of the carrying trunnion axis, are provided in the plane below the bearing faces of the bearing housings on the load cells for accommodating tilting forces during an expansion bearing displacement. Furthermore, hydraulic lifting cylinders are provided between the sole plate and the bearing housing for installing and removing the load cells.

BRIEF DESCRIPTION OF THE DRAWINGS

The invention shall now be described by way of example and with reference to the accompanying drawings, wherein.

DESCRIPTION OF A PREFERRED EMBODIMENT

Figure 1:
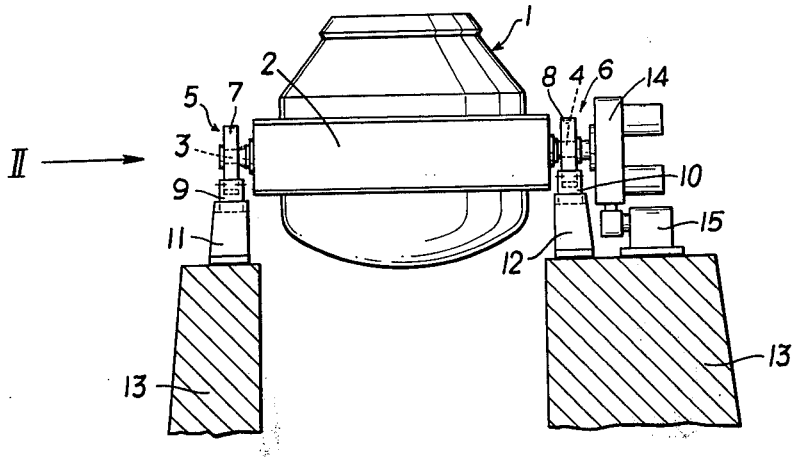
FIG. 1 shows the overall arrangement of a converter plant in front view.

In FIG. 1 a converter of a steel making plant is inserted in a carrying ring 2 that is provided with two carrying trunnions 3 and 4. The carrying trunnions are mounted in an expansion bearing 5 and a fixed bearing 6, whose bearing housings 7 and 8 rest on one force measuring means each (9 and 10). The force measuring means are arranged on pedestals 11 and 12 that are rigidly connected to a base 13. The carrying trunnion 4 associated with the fixed bearing is connected with a tilting drive 14 that is supported relative to the base via a torque support 15.

Figure 2:
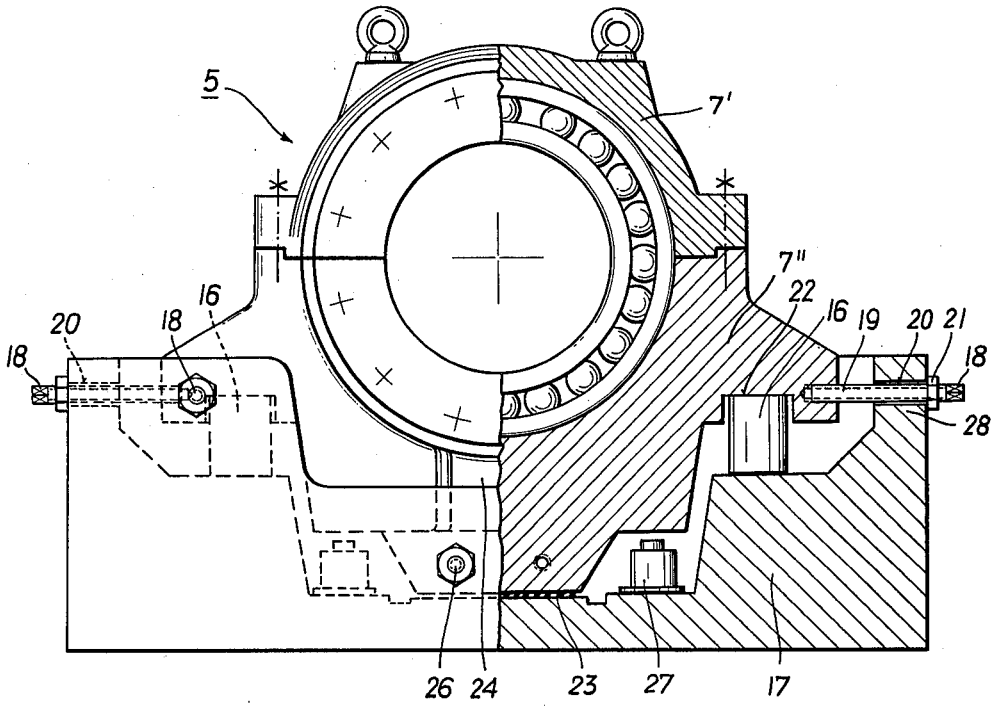
FIG. 2 is a view of a carrying trunnion bearing with a force measuring device, in the direction of the arrow II of FIG. 1 on a larger scale and partly in section.
Figure 3:
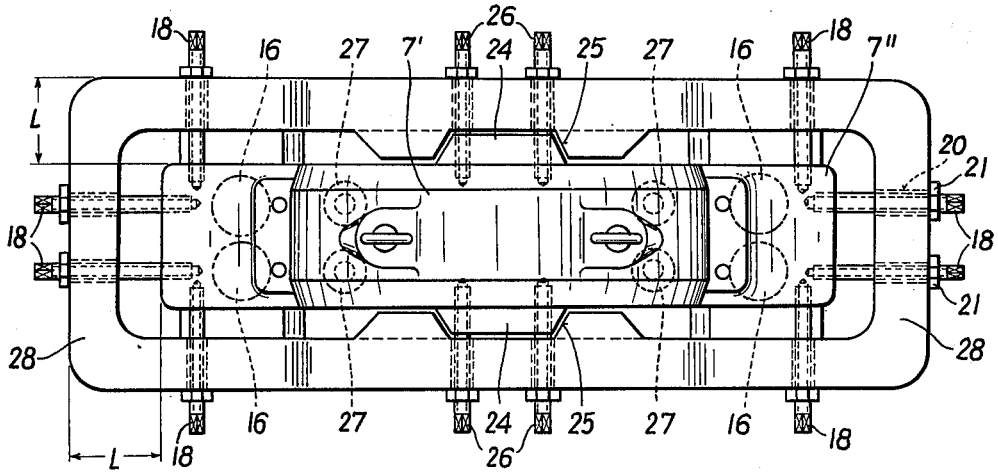
FIG. 3 is a ground plan.

FIGS. 2 and 3 illustrate the construction of the expansion bearing 5 and its force measuring means 9. The fixed bearing and the force measuring means associated with it are constructed in the same way. The bearing housing 7 of the expansion bearing is composed of the bearing upper part 7' and the bearing lower part 7''. The bearing lower part 7'' rests on four load cells 16 that sit on a sole plate 17. The sole plate in turn is arranged on the pedestal 11 that is secured to the base. The bearing lower part 7'' is secured relative to the sole plate by bolts 18 arranged in pairs oppposite each other in the horizontal plane. These bolts, which are arranged both in the direction of the carrying trunnion axis and at a right angle thereto, are rigidly connected at one end 19 with the bearing lower part and are guided with play through bores 20 arranged on the upwardly extending walls 28 of the sole plate. The bolts are also braced from the outside relative to the sole plate by means of adjusting nuts 21. The bearing housing connected in this way with the sole plate forms, together with the sole plate, a system that yields only slightly in the vertical direction and is rigid in the horizontal direction. It becomes apparent that all the forces acting on the bearing in the horizontal direction are accommodated by the bolts 18 as tensile forces and are thus prevented from acting on the load cells as transversal forces. The axes of the bolts 18 extend in the plane of the bearing face 22 of the bearing lower part that rests on the load cells, whereby a reaction moment caused by horizontal forces, which reaction moment would constitute a transversal force for the load cells is prevented. Thus the bolts 18 and the load cells 16 exhibit a definite allocation of forces. Therefore, the wear on the bolts is less than that of an intermediate plate, and for that reason common engineering steels can be used as material for the bolts.

During operation, the bearings move by up to about 0.4 mm in the vertical direction, i.e. the bolts 18 are deformed according to their bending lengths L. By an appropriate, calibration of the load cells a falsification of the measuring result can be prevented since the deformation is accommodated by the bolts in a simple manner.

A rubber plate 23 is inserted between the housing lower part 7'' and the bottom part of the sole plate 17, which rubber plate accommodates the full weight of the converter when the load cells or the bolts fail. As a result there is no interruption of the operation. On the bearing housing lower part 7'', two opposing noses 24 pointing in the direction of the trunnion axis are provided. The noses engage with a play of between 3 and 5 mm in corresponding recesses 25 of the sole plate. These noses prevent a displacement of the bearing housing when the load cells and the bolts fail, so that an immediate stand-still of the operation is not required. Further bolts 26 serve for supporting the tilting moments arising from the axial forces created by the expansion bearing displacement. These bolts 26 are arranged on both sides of the sole plate 17 in the direction of the carrying trunnion axis below the bearing face 22 of the bearing housing that rests on the load cells and act to accommodate positive and negative moments. For purposes of repair or assembly of the load cells, hydrualic cylinders 27 are arranged between the sole plate and the bearing housing lower part.

What we claim is:

1. A tiltable metallurgical converter arrangement, in particular a steel making converter arrangement, which comprises:

a metallurgical converter vessel, carrying trunnions tiltably supporting said metallurgical converter vessel, a fixed bearing and an expansion bearing accommodating said carrying trunnions, bearing housings enclosing the fixed bearing and the expansion bearing, load cells for indicating the weight of the contents of the vessel, the bearing housings being arranged upon said load cells, a supporting construction including sole plate means on which the load cells rest, and connecting means for accommodating tensile forces being arranged opposite each other in a horizontal plane and securing the bearing housings relative to the supporting construction.

2. A tiltable metallurgical converter arrangement as set forth in claim 1, wherein the connecting means are arranged in a plane through the bearing faces of the bearing housings which rest on the load cells.

3. A tiltable metallurgical converter arrangement as set forth in claim 1, wherein the connecting means are arranged both in the direction of the carrying trunnion axes and perpendicular thereto.

4. A tiltable metallurgical converter arrangement as set forth in claim 1, wherein the sole plate means are provided with bores and wherein the connecting means are designed as screw bolts with adjusting nuts, the screw bolts being guided with play in said bores.

5. A tiltable metallurgical converter arrangement as set forth in claim 1, wherein each bearing housing has two noses arranged opposite each other and pointing in the direction of the carrying trunnion axis and wherein each sole plate means has recesses substantially corresponding to the two noses, said noses engaging with play in said recesses.

6. A tiltable metallurgical converter arrangement as set forth in claim 1, wherein each sole plate means has a bottom portion and wherein an intermediate rubber layer is provided between each bearing housing and said bottom portion.

7. A tiltable metallurgical converter arrangement as set forth in claim 2, wherein each bearing housing has two noses arranged opposite each other and pointing in the direction of the carrying trunnion axis and wherein each sole plate means has recesses substantially corresponding to the two noses, said noses engaging with play in said recesses, and wherein, in the area of the recesses, additional connecting means for accommodating tensile forces are provided opposite each other in the direction of the carrying trunnion axis in a plane below the plane in which the bearing housings rest on the load cells, said additional connecting means accommodating tilting forces during an expansion bearing displacement.

8. A tiltable metallurgical converter arrangement as set forth in claim 1, further comprising hydraulic lifting cylinders arranged between the sole plate means and the bearing housings for installing and removing the load cells.

* * * * *

UNITED STATES PATENT AND TRADEMARK OFFICE

CERTIFICATE OF CORRECTION

PATENT NO. : 4,023,785

DATED : May 17, 1977

INVENTOR(S) : Ernst Riegler et al.

It is certified that error appears in the above–identified patent and that said Letters Patent are hereby corrected as shown below:

First page, line 6 of Abstract, after "by" insert --connecting means--;

line 7 of Abstract, delete "connecting means".

Col. 1, line 54, "th" should read --the--.

Col. 2, line 2, after "struction" insert a comma;

line 21, "pay" should read --play--;

line 52, after "converter" insert --1--.

Col. 3, line 26, after "cells" insert a comma; and line 36, after "appropriate" delete the comma.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*